United States Patent [19]

Kossak

[11] 4,015,307

[45] Apr. 5, 1977

[54] APPARATUS FOR CLEANING ROTATING CYLINDRICAL SURFACES

[75] Inventor: Joseph J. Kossak, Roselle, N.J.

[73] Assignee: Oxy-Dry Sprayer Corporation, Chicago, Ill.

[22] Filed: Nov. 20, 1974

[21] Appl. No.: 525,478

Related U.S. Application Data

[63] Continuation of Ser. No. 66,524.

[30] Foreign Application Priority Data

Aug. 25, 1969 United Kingdom ..... 42333/69

[52] U.S. Cl. ..... 15/256.52; 101/425

[51] Int. Cl.[2] ..... A46B 15/00; B41F 35/00; B41L 41/00

[58] Field of Search ..... 101/425, 148; 15/256.51, 256.52, 256.53, 100, 102

[56] References Cited

UNITED STATES PATENTS

| | | | |
|---|---|---|---|
| 437,863 | 10/1890 | Marvin et al. | 101/425 |
| 1,239,295 | 9/1917 | Noble | 15/100 |
| 2,691,344 | 10/1954 | McMullen | 101/425 |
| 2,751,616 | 6/1956 | Turner, Jr. et al. | 101/425 |
| 2,816,303 | 12/1957 | Klaar | 15/77 X |
| 2,852,791 | 9/1958 | Febinger | 15/77 |
| 3,084,626 | 4/1963 | Stobb | 101/425 |
| 3,089,415 | 5/1963 | Grembecki et al. | 101/425 |
| 3,217,646 | 11/1965 | Sharkey | 101/425 |
| 3,309,993 | 3/1967 | Grembecki et al. | 101/425 |

FOREIGN PATENTS OR APPLICATIONS

| | | |
|---|---|---|
| 1,351,365 | 12/1963 | France |

*Primary Examiner*—Edgar S. Burr
*Assistant Examiner*—Paul J. Hirsch
*Attorney, Agent, or Firm*—Leydig, Voit, Osann, Mayer & Holt, Ltd.

[57] ABSTRACT

A means, for removing undesired foreign matter from rotating cylindrical surfaces, such as, for example, the blanket of a blanket cylinder in an offset press, comprises a scrub means including a rotatable brush and an absorbent wiper roller. Solvent is applied to the brush so that it is uniformly wetted and a flicker bar is employed which presents a substantially flat inclined surface so that solvent and foreign matter is removed from the bristles of the brush. A tapered drain, generally in connection with a fluid such as water to flush the drain, prevents undue build-up of the matter removed from the brush bristles.

10 Claims, 8 Drawing Figures

INVENTOR.
JOSEPH J. KOSSAK
BY
Wolfe, Hubbard, Leydig, Voit & Osann
ATTORNEYS.

INVENTOR.
JOSEPH J. KOSSAK
BY
Wolff, Hubbard, Leydig, Voit & Osann
ATTORNEYS.

INVENTOR.
JOSEPH J. KOSSAK

BY
Wolfe, Hubbard, Leydig, Voit & Osann
ATTORNEYS.

INVENTOR.
JOSEPH J. KOSSAK
BY
Wolfe, Hubbard, Leydig, Voit & Osann
ATTORNEYS.

APPARATUS FOR CLEANING ROTATING CYLINDRICAL SURFACES

This is a continuation of application Ser. No. 66,524, filed Aug. 21, 1970, now abandoned.

This invention relates to cleaning devices and, more particularly, to a means for cleaning rotating cylindrical surfaces such as, for example, the blankets of blanket cylinders on offset presses.

During printing on an offset press, the blankets on the blanket cylinders accumulate foreign matter such as dried ink or ink build-up, paper lint, clay, dirt and the like which must be removed to maintain the quality of printing. Therefore, during a specific run or job, these blankets must be washed at various times during the running of the job. Additionally, the blankets must also be washed to remove the image when the job is complete. Still further, the blankets must be washed during "make-ready" operations.

Typically, this cleaning operation is carried out by hand. The pressman will generally apply any of several well-known conventional solvents by means of a cloth saturated with solvent to remove the ink and other foreign matter. This practice involves possible health hazards due to, among other things, the exposure of the area to the toxic solvents. The resulting messy cloths, of course, have to be discarded and this is a problem. In addition, the pressman in cleaning the blankets on the cylinders when the press is at a standstill must jog the press periodically so that the complete circumference of the cylinder can be washed. This jogging of the press can be the cause of accidents. A cleaning operation of this type may take anywhere from five to ten minutes or even more; and, depending upon the type of printing operation and the length of the run, an average of anywhere from about five to ten or even more washes may be required per 8-hour operating shift, this loss of press time constitutes a significant economic loss. Consequently, it is not unusual for a pressman to delay this cleaning operation until the quality is actually below an acceptable standard as opposed to when quality actually requires it.

Because of the problems associated with cleaning the blankets on cylinders and the like by hand, considerable effort has been expended to provide an automatic or semi-automatic means for accomplishing this cleaning. However, the hurdles which must be overcome to develop a satisfactory cleaning device are quite substantial. Several types of presses have only a minimal amount of space in and around the blanket cylinders so that any unit utilized must be compact. Further, because the pressman must carry out such functions as removing and replacing the blanket or offset plate or making other cylinder repairs or adjustments, the unit must either be very small or be capable of being easily removed.

In addition to the spatial problems, probably the most significant problem which must be overcome is the fouling of the apparatus by the foreign matter which is being removed. To be effective, the blanket washer apparatus must be capable of removing foreign matter from the surface being cleaned and then transporting the material removed from the surface and the apparatus in such a fashion as not to foul the apparatus and impair its cleaning ability. In short, the apparatus must be essentially self-cleaning so that it is capable of operating in a trouble-free manner for a long period of time.

One solution to this problem is illustrated in Grembecki et al., U.S. Pat. No. 3,309,993. In this patent, a driven brush and a wiper roll are contained in a housing which may be pivoted to move both the brush and the wiper roll into contact with the blanket surface. Cleaning of the brush is contemplated by contacting the brush with a stationary rod having a knurled surface. While suitable for carrying out the blanket washing operation, the unit, in practice, has not provided the trouble-free reliability that is so desirable.

It is accordingly an object of the present invention to provide means for automatically scrubbing rotating cylindrical surfaces to remove undesired foreign matter, carrying away the foreign matter and drying the surface in a quick and efficient manner.

Another object of the present invention is to provide an apparatus which is essentially self-cleaning.

A still further object lies in the provision of such an apparatus in which the component parts are easily accessible so that inspection and maintenance, if necessary, may be readily carried out.

A more specific object is to provide apparatus of the above-described type wherein the flow of solvent for the cleaning operation is controlled to achieve uniform cleaning. A related object provides a maximum amount of cleaning with a minimum amount of solvent.

Yet another object provides an apparatus which is highly reliable and which carried out the cleaning cycle in a minimum amount of time.

Another object is to provide an apparatus which minimizes paper spoilage, achieves longer blanket life and obviates gumming and other operations.

Other objects and advantages will become apparent as the following description proceeds, taken in conjunction with the accompanying drawings in which:

FIG. 1 is a side elevation view of one embodiment of the cleaning device of the present invention, shown in the inoperative position, in relation to a fragmentary portion of the blanket cylinder of a sheet-fed offset printing press machine and with the operative positions being shown in phantom;

Figure 2:
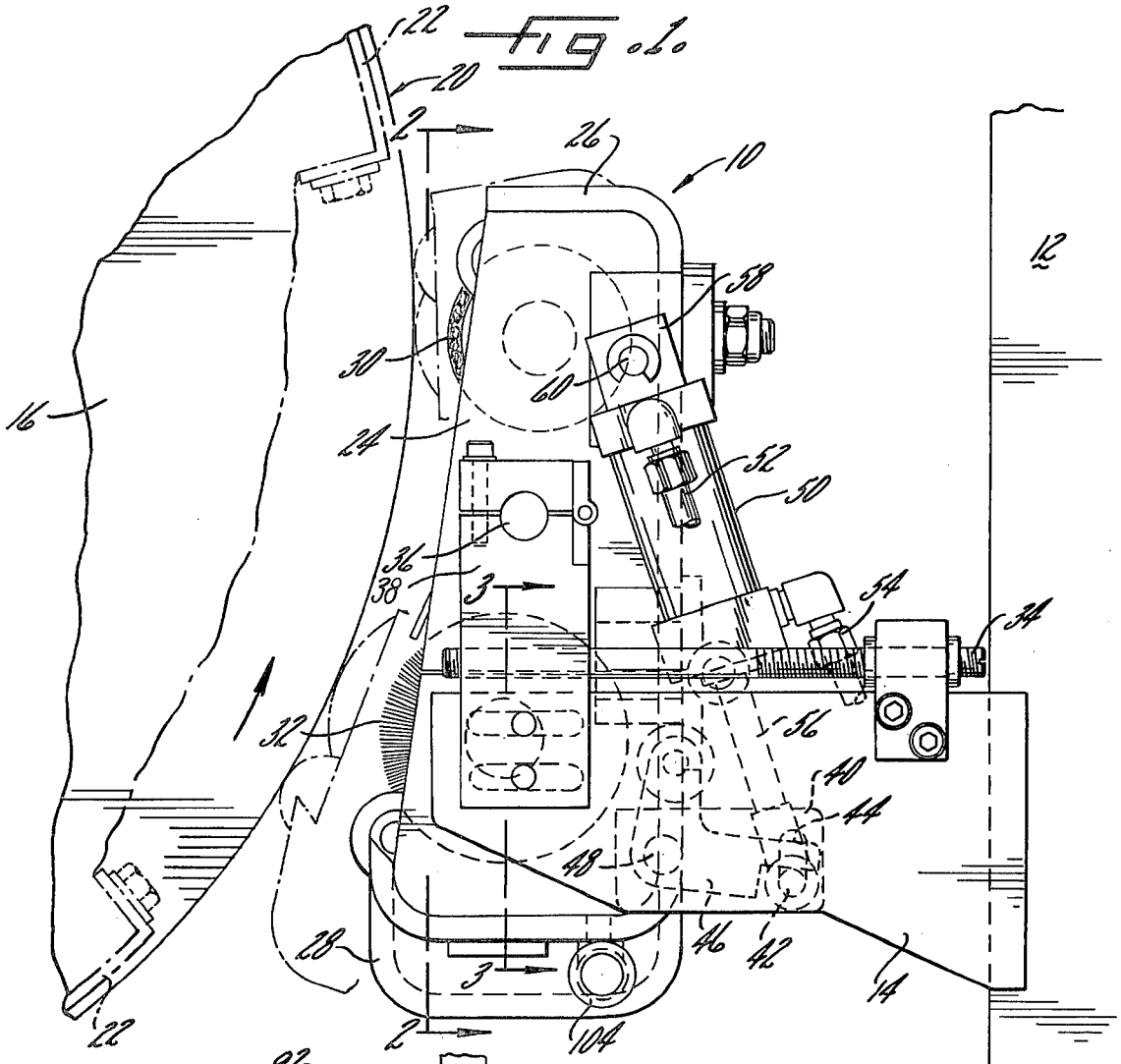
FIG. 2 is a cross-sectional view taken substantially along lines 2—2 of FIG. 1 and illustrating the housing for the components of the device and the drain for carrying away the ink and other foreign matter.

While the invention is susceptible of various modifications and alternative constructions, there is shown in the drawings and will herein be described in detail the preferred embodiments. It is to be understood, however, that it is not intended to limit the invention to the specific forms disclosed. On the contrary, it is intended to cover all modifications and alternative constructions falling within the spirit and scope of the invention as expressed in the appended claims. For example, while the present invention may be advantageously used in connection with cleaning the blanket cylinders on sheet-fed offset presses and this will be the specific use which will be described herein, it should be appreciated that the present invention is readily applicable to the cleaning of other rotating cylindrical surfaces.

Briefly, the present invention provides a means for removing undesired foreign matter from rotating cylindrical surfaces by a scrubbing and wiping cycle which involves only a minimum time. The surface is first cleaned by brushing with bristles wet with solvent for the foreign matter, with solvent being added as needed during the brushing to accomplish the desired cleaning action. Means are provided to clean the bristles during each revolution and to carry away the foreign matter and solvent removed from the bristles. After the scrubbing has been completed, a wiper roller is moved into position and the cycle is completed by wiping the surface dry.

Turning now to the drawings, FIGS. 1 through 6 show one exemplary embodiment of the device of the present invention. Thus, as is shown in FIG. 1, the cleaning device or assembly generally designated at 10, is mounted on the side plate 12 of the sheet-fed offset printing press machine via side arm 14. As shown, the device 10 is located adjacent the blanket cylinder 16, of a printing press, only a fragment of which is shown, including a bearer 20 and a blanket 22. The assembly 10 includes a housing 24 having upper and lower sections 26, 28, respectively, which contain a wiper roller 30 and a brush roller 32. To provide quicker and more accurate positioning, especially when the press is running, the spatial positioning of the assembly 10 from the surface of the blanket 22 (when the unit is in its inoperative position) can be modified by movement of the screw assembly 34.

To move the brush rollers and the wiper roller into and out of contact with the surface to be cleaned, means are provided to carry this out by the pivoting of the unit housing. As is best seen in FIGS. 1 and 2 (one side being shown in FIG. 1 and both sides in FIG. 2), the upper section 26 of the housing 24 is provided with trunnions 36 which are journaled in the upper section 38 of support bracket assemblies 40 which are supported by the side arms 14 mounted to the press frame. The bracket assemblies 40 include pivot pins 42 mounted in slots 44 and bell crank bearing shafts 46 pivotally mounted to pins 42 and the bracket assemblies 40 at 48.

The housing is designed to pivot about the trunnions 36. Thus, pneumatic cylinders 50 are provided, which may be of a conventional construction and operable through flexible pneumatic lines 52, 54 in a manner well known to those of ordinary skill in the art. Piston rods 56 of the cylinders 50 are pivoted on pins 42 of the bracket assemblies 40 and the cylinder casings 58 of the cylinders 50 are pivoted at 60 to stud shafts 62, which extend from the sidewall of the upper section 26 of the housing 24.

Figure 6:
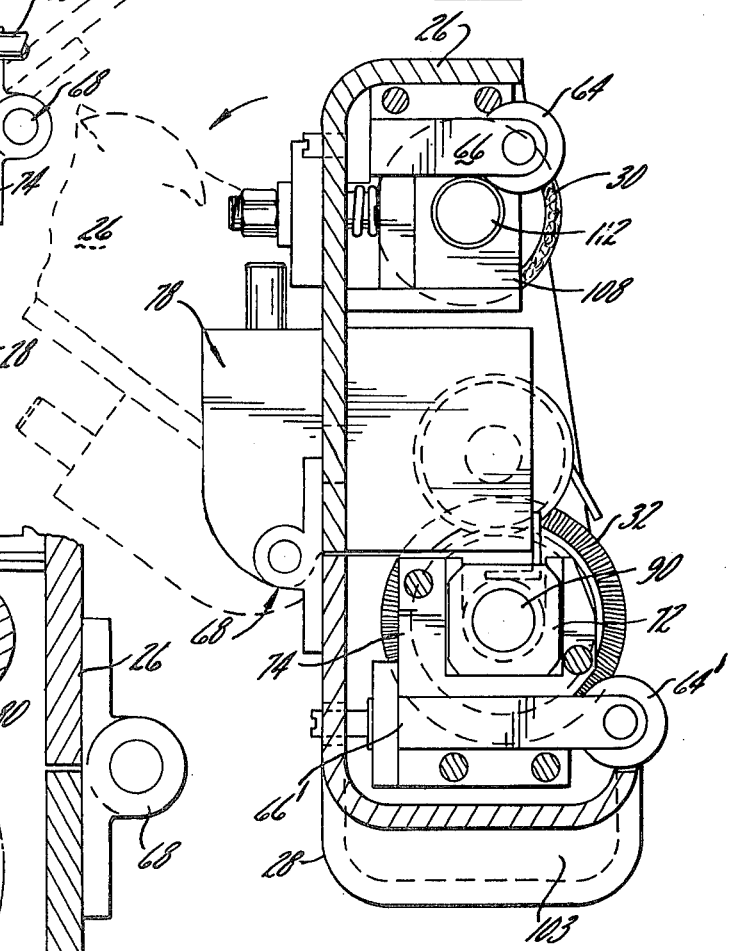
FIG. 6 is a cross-sectional view taken substantially along lines 6—6 of FIG. 2 and showing the driving means for the brush roller.

To provide limits for positioning the wiper roller and brush roller in contact with the surface to be cleaned, stop means are provided which engage the bearer of the blanket cylinder so as to provide a fixed, uninterrupted locating surface. As best seen in FIG. 6, this means comprises roller assemblies 64, 64' which are mounted on arms 66, 66' located, respectively, in the upper and lower sections of the housing.

When the pneumatic cylinder is not charged, the device assumes the inoperative position which is illustrated in FIG. 1. To bring the device into position for brushing action, the cylinders 50 are charged through hoses 54 whereby the casings 58 pivot the assembly about the trunnions 60 until the stops engage the bearer thereby bringing the brush into engagement with the cylindrical surface of the blanket 22. The piston rods 56 should be of sufficient length so that an excess charge is maintained in the cylinders after the stops 64' have contacted the bearer so that the stops are at all times maintained in firm contact with the bearer. In similar fashion, upon charging the pneumatic cylinders 50 through the lines 52, the assembly is pivoted in the opposite direction until rotary stops 64 engage the bearer thereby bringing the wiper roller 30 into engagement with the blanket and holding the assembly in position for the wiping action. As must be appreciated, the respective pivotal connections 42 and 60 between the casings 58 and the piston rods 56 should be arranged in such a manner that the pneumatic cylinders 50 position the housing 24 either in an inoperative position, in position for a brushing action or in position for a wiping action.

Figure 4:
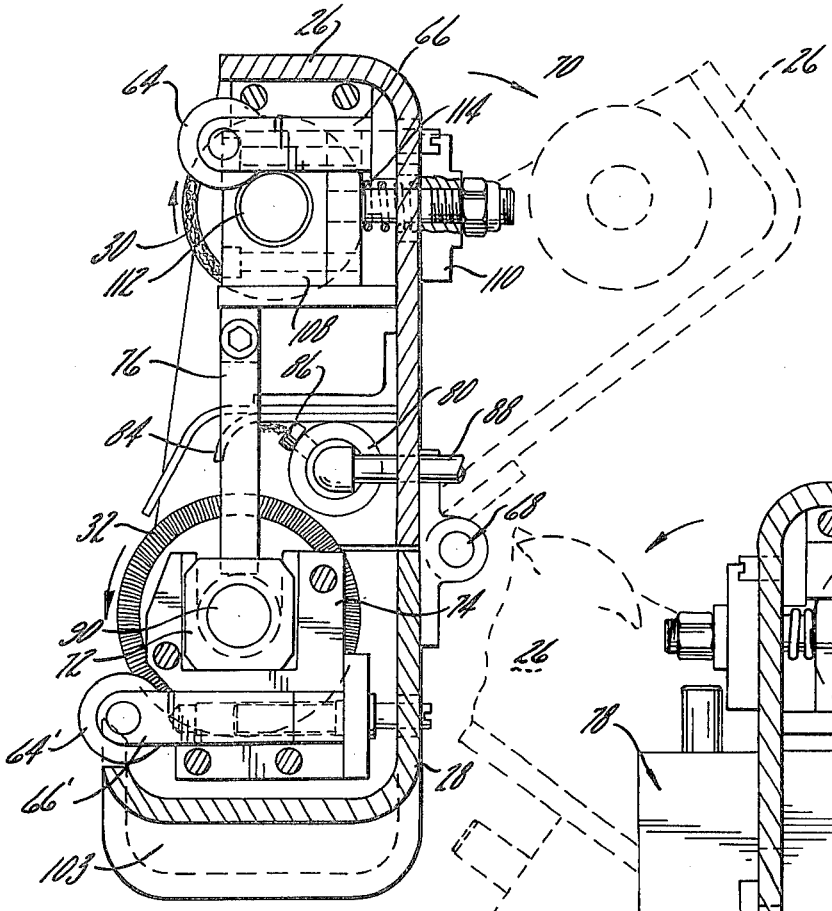
FIG. 4 is a cross-sectional view taken substantially along lines 4—4 of FIG. 2 and illustrating the easy accessibility to the components of the cleaning device of the present invention and the resilient mounting of the wiper roller.
Figure 5:
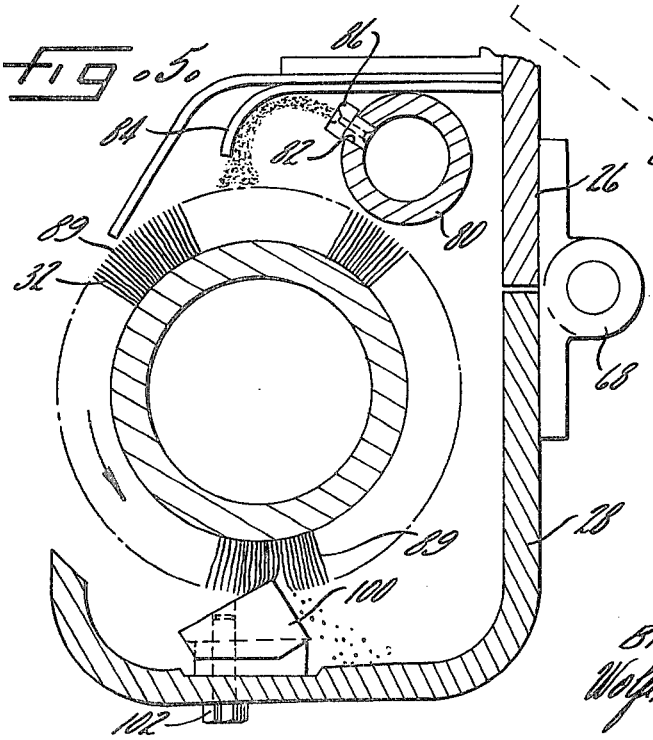
FIG. 5 is a fragmentary cross-sectional view taken substantially along lines 5—5 of FIG. 2 and showing the means for applying solvent to the brush and the means for cleaning the brush bristles.

In accordance with one aspect of this invention, the cleaning device of the present invention is designed so that its components are readily accessible so that the unit may be readily serviced or moved out of position to enable the pressman to service the blanket or blanket cylinder. To this end, and as is shown in FIGS. 4–6, the upper section 26 and lower section 28 of the housing are hingedly connected as shown at 68 so that the upper section 26 can be swung in the direction shown in phantom at 70. Accordingly, when the upper section has been swung back, all of the components contained in the housing 24 are readily exposed for servicing.

To further enhance servicing of the brush roller 32 (see FIGS. 2–4), it may be mounted in bearings 72 which are in turn mounted in saddle blocks 74. With such a mounting, the brush roller 32 may be easily lifted out of its mounting when this is necessary. Maintaining the brush roller in its proper position for operation is achieved by bearing supports 76 which are affixed to the upper section of the housing. The supports 76 swing back with the upper section of the housing to expose the bearings 72 but move into position to maintain the bearings 72 in the saddles 74 when the housing is in its operative position.

The brush roller is desirably driven and rotated in a direction opposite to that of the surface being cleaned at a rate such that effective cleaning is accomplished. The speed at which the brush roller is rotated can be varied within wide limits, the principal criteria being that the speed is sufficient to provide effective cleaning in a minimum time. For example, a speed of about 120 revolutions per minute has been found to be satisfactory for most purposes. While any conventional rotor and gear system may be employed, the exemplary embodiment (FIG. 6) includes a motor and flexible drive shaft (both not shown) which drives the brush roller 32 through a gear system shown generally at 78. It has been found suitable, as an example, to use a conventional ½ h.p. motor (1725 r.p.m.).

In accordance with a further aspect of the present invention, means are utilized to provide the brush with solvent in such a fashion that so that, in turn, the blanket is cleaned without the appearance of streaks or the like. To this end, and as is best seen in FIGS. 2 and 5, a solvent tube 80 having a series of spaced holes 82 is positioned in the upper portion of the lower section 28 of the housing 24. A baffle 84 is positioned adjacent the solvent tube 80 and the top portion of the brush roller 32. A plurality of nozzles 86, fitted in the holes 82, receive the solvent discharging from the solvent tube 80 and direct it at the baffle 84. The spacing and direction of the nozzles should be such that the individual solvent sprays are transformed into a falling waterfall which is substantially uniform so as to uniformly wet the bristles 88 of the brush roller 32. The ingress and egress portions of the nozzles may be chamfered to allow for unrestricted passage by the solvent. As a specific example, the nozzle passage may have a diameter of 0.031 inch with a hole spacing of about ¾ inch.

It should be appreciated that the combined function of the nozzles and the baffle plate is to present a substantially continuous stream ("waterfall") of solvent to the brush roller as opposed to a number of spaced streams. Accordingly, if desired, the same function can be accomplished by employing spaced nozzles which direct the solvent directly onto the brush roller but which spread out or atomize the spray, the discharge from the spaced nozzles combining to form substantially a continuous stream.

The solvent or solvents which are utilized may be any of those which have been conventionally used for cleaning blanket surfaces. For example, the solvent may suitably comprise a mixture of aliphatic hydrocarbons, xylene and ethylene glycol monoether. A variety of such solvents are commercially available. Also, it may be desirable to employ, sequentially or concurrently, a number of solvents and/or blanket conditioners together. For example, in the case of cleaning the blankets on offset presses, it may be desirable to first utilize water as a solvent to rid the blanket of gum, clay coatings, antioffset powders and other water-soluble materials which may be on the blanket and then use an organic solvent for the ink. As can be seen, the solvent (from a source not shown) may be supplied to the solvent tube 80 through line 88 (See FIG. 4).

With respect to the brush roller, a wide variety are commercially available and may be employed. The prime requirements are that the bristles are chemically resistant to the solvents which are employed, are sufficiently pliable so that the surface being cleaned is not significantly damaged and yet are sufficiently rigid so that, as will hereinafter be discussed in detail, they may be readily cleaned by flexing. To prevent potential problems with respect to bowing and to minimize the shock or vibratory effects when the brush hits the gap in the blanket cylinder, it is preferred to mount the brush so that it is skewed with respect to the blanket and also to use a brush which is slightly tapered. As an illustrative example, the brush roller may comprise a thinwall steel core upon which is mounted a layer of nylon thread with which an adhesive, such as an epoxy, has been employed. The bristles are embedded in the nylon layer. The length and diameter of the bristles should be coordinated to provide the desired flexibility and resiliency. For example, the bristle lengths can vary from ⅜ inch to ½ inch with the diameter varying from 0.010 inch to 0.012 inch. Desirably, the density of the bristles is such that it is medium full, as that term is used in commercial practice. As an example of the type which may be employed, the diameter in the center portion may be three inches whereas the outer thirds of the roller should have diameters of 2 31/32 inches. This provides a lightweight, compact construction which enhances the reliability of the unit.

Figure 3:
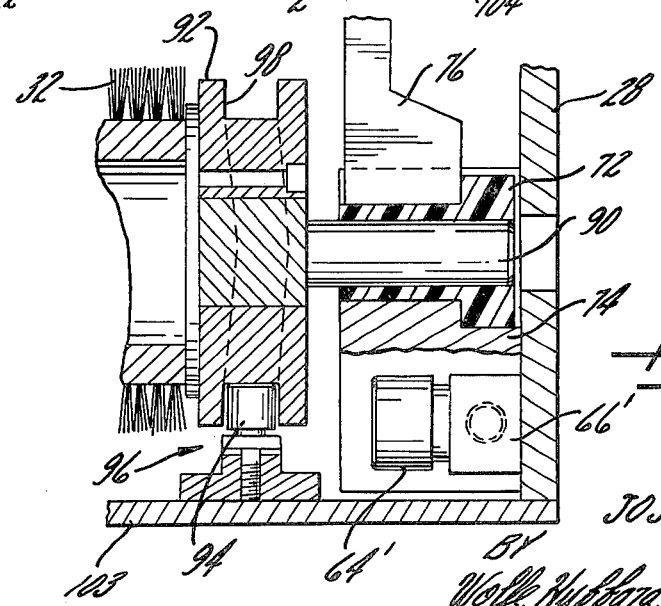
FIG. 3 is a fragmentary cross-sectional view taken substantially along lines 3—3 of FIG. 1 and showing the means for mounting the brush roller as well as the means for providing vibratory movement of the brush to enhance its cleaning action.
Figure 2:
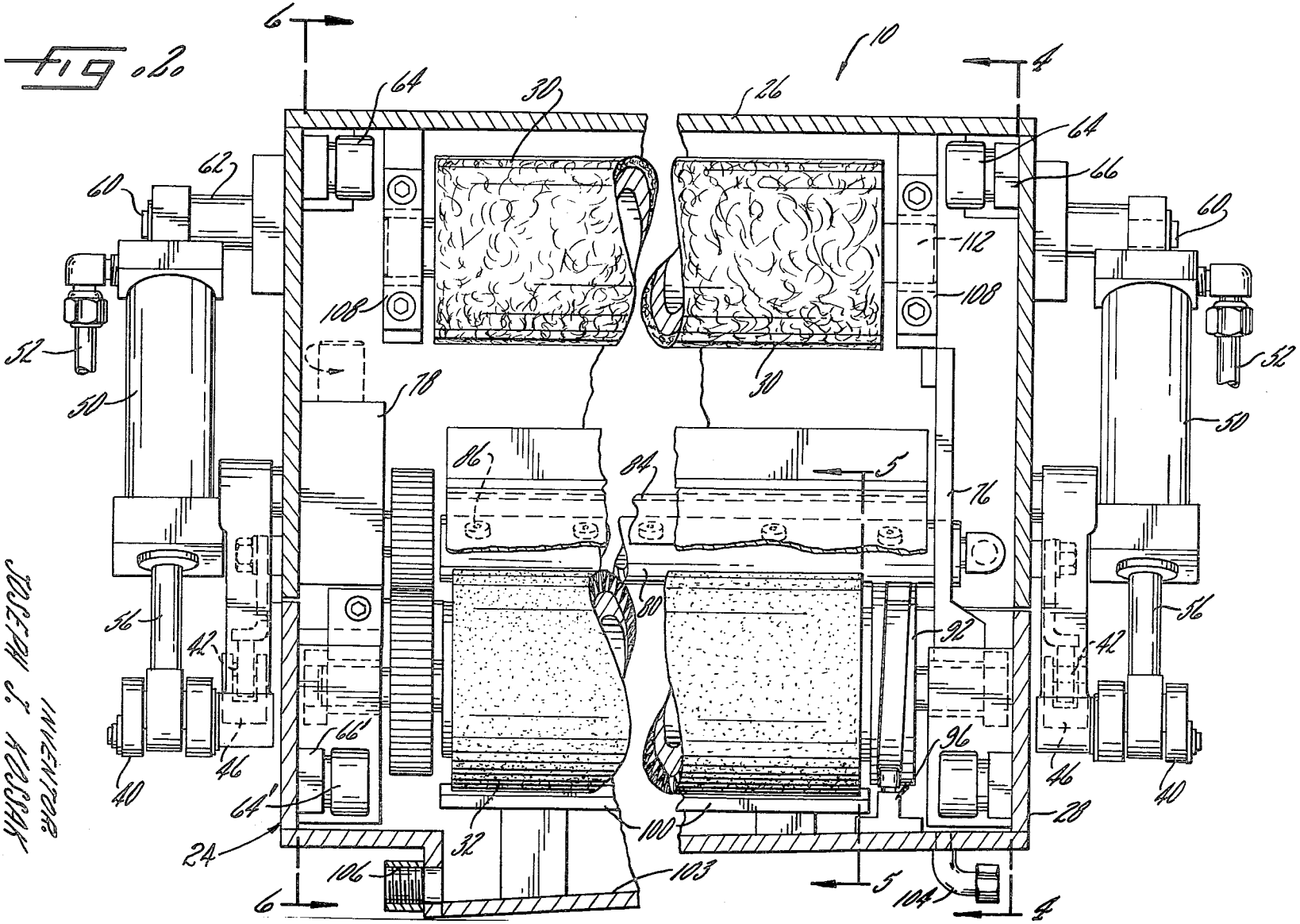

To enhance the scrubbing action and thus the cleaning action, there is provided a means for causing the rotating brush to oscillate as it is rotating. Thus, as is illustrated in FIG. 3, the brush roller shaft 90 is provided with a cylindrical cam 92 on one end thereof. A cam follower 94 is mounted to the housing 24 as indicated at 96. Upon rotation of the brush roller 32 by its drive assembly, the cam follower 94 rides on a cam profile 98 which causes the brush to simultaneously reciprocate so as to impart an oscillatory motion to the brush.

In accordance with a still further aspect of the present invention, means are provided to remove the solvent and foreign matter from the bristles of the brush roller. To this end, a flicker bar is provided which includes a substantially flat inclined surface which is positioned to contact the bristles at an angle and for a distance sufficient to allow the individual bristles to flex so as to remove the solvent and foreign matter therefrom. The flicker bar is positioned with respect to the brush so that essentially all of the material which is removed from the bristles is deflected away from the brush and is not allowed to return to the brush so as to contaminate the thus-cleaned brush. By the term "flexing" it is meant that the individual bristle in contacting the inclined surface is caused to be sequentially and progressively bent and then allowed to return to its normal position as it leaves the inclined surface in such a fashion that this return causes the removal of the solvent and foreign matter from the bristles. Thus, and as is shown in FIG. 5, the bristles 89 contact a flicker bar 100, which desirably extends the length of the brush. The flicker bar 100 may be mounted on the bottom section of the housing by any suitable means, such as for example by bolts such as are shown at 102. The angle of the flicker bar with respect to the horizontal may be varied depending upon the position of the bar with respect to the brush. When the flicker bar is positioned at the bottom of the brush, as is shown in FIG. 5, the angle may vary from about 25° to 45°, with about 30° to 35° being preferred. Additionally, the distance between the initial contact of the bristle with the flicker bar surface and the end of the contact with the surface may vary within certain limits. In the illustrative embodiment, it has been found suitable to allow a surface contact of ⅛ inch. The specific distance should be sufficient so that the individual bristle will be allowed to flex but should not be so great as to damage the drive means for the brush roller that is being employed. The flicker bar may be made of any suitable material, but the specific material employed should be wear-resistant as regards the continued contact with the bristles that are used. For example, it has been found to be generally suitable to employ a flicker bar made of stainless steel.

According to another aspect of the present invention, a drain means is provided so that the solvent and foreign matter which is removed from the surface of the blanket is transported away from possible contact with the brush as might occur with a build-up of residue. Desirably, and to achieve all of the advantages of the present invention, means are also provided to pass fluid, such as water, through the drain to assist in transporting the matter and to prevent any undue build-up. Thus, as is shown in FIG. 2, the bottom of the housing 24 is formed with a drain trough 103 which is tapered from one side to the other. The exact taper may vary widely; however, is has been found adequate to employ a taper of about ⅞ inch across the drain for a 60 inch or 78 inch unit. Also, to aid in the draining, fluid (from a source not shown) may enter through line 104 and exit through line 106.

Following removal of the ink and foreign matter by the cleaning action of the scrubbing, the surface is wiped dry. The wiping action may be achieved by maintaining an absorbent wiper roller against the blanket surface following completion of the scrubbing cycle. As can be seen in FIG. 4, the wiper roller 30 is carried by assembly 108 which terminates in a trunnion 110 journaled in bearings 112. The wiper roller is frictionally driven upon contact with the surface of the blanket cylinder and may suitable comprise a layer of flannel beneath an outer absorbent layer, preferably an absorbent cotton material. It is desirable to maintain the wiper roller 30 in contact with the surface of the blanket roller by resilient biasing means, such as spring 114.

Figures 7, 8:
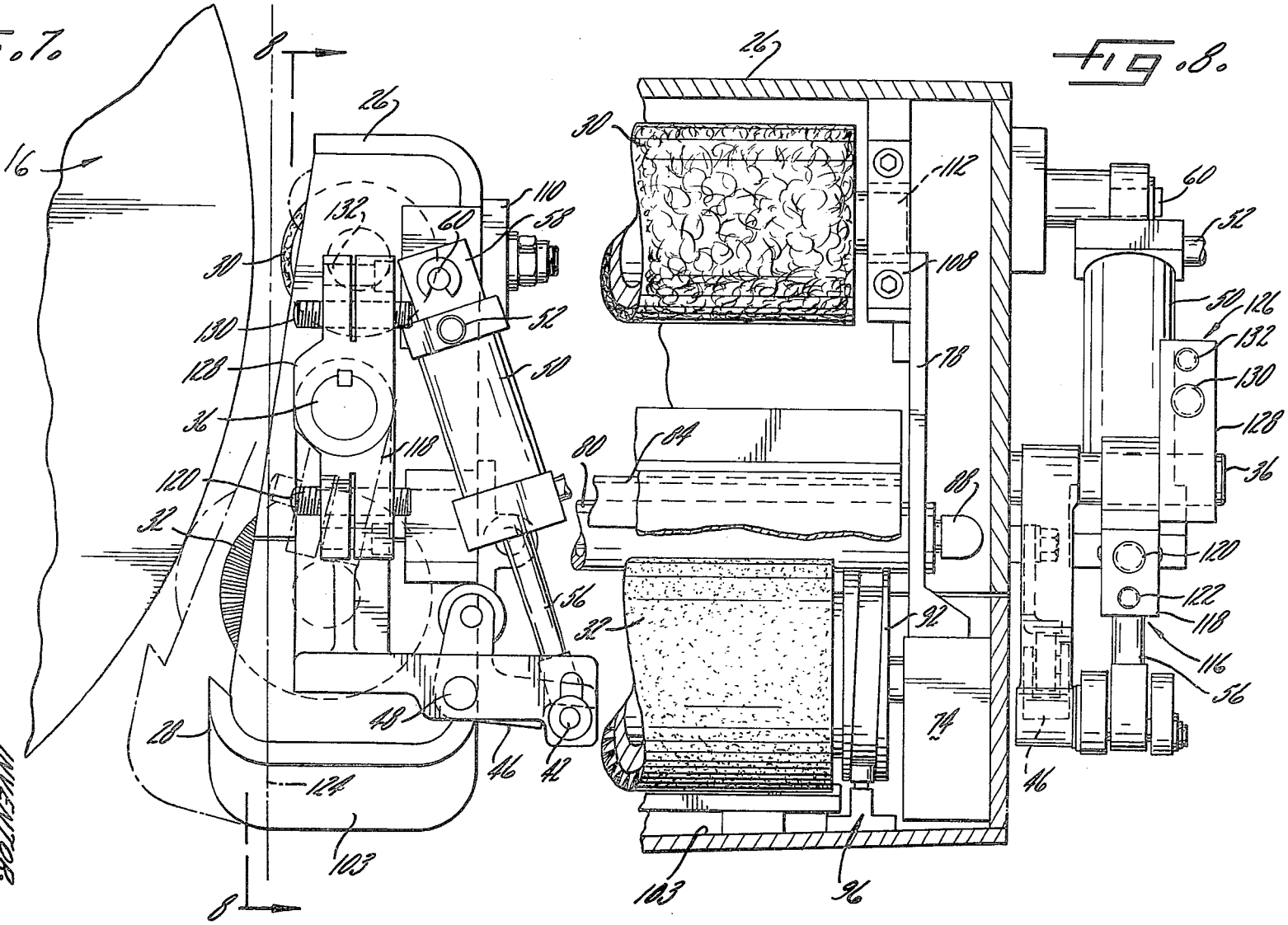
FIG. 7 is a side elevation view of the cleaning device of the present invention and showing an alternative embodiment for positioning the device in its operative positions against the blanket surface.
FIG. 8 is a cross-sectional view taken substantially along lines 8—8 of FIG. 7 and illustrating, in further detail, the alternative embodiment.

In some situations where spatial limitations dictate or where the press cylinders do not include bearers, the positioning means for the unit must be different from that set forth in the embodiment illustrated in FIGS. 1 through 6. Accordingly, in such situations, a positioning means as is illustrated in FIGS. 7 and 8 may be employed. As shown, the positioning means employed provides a dead stop positioning which functions to maintain, sequentially, the brush roller and wiper roller in their operative positions. Thus, a brush roller positioning means 116 includes a brush roller stop block 118, carrying an adjustable brush roller stop 120 and a lock screw 122 for the adjustable stop 120. Positioning may be achieved, for example, by manually rocking the housing so that the brush roller is placed in its operative position. Stop 120 is then adjusted to contact its reference point, side frame 124 (FIG. 7), and locked into place by setting screw 122.

The positioning means for the wiper roller is the same. Accordingly, a wiper roller positioning means 126 includes a wiper roller stop block 128, carrying an adjustable wiper roller stop 130 and a lock screw 132 for the adjustable stop 130. After rocking the housing to place the wiper roller against the blanket, positioning is achieved in the same manner as has been described in connection with the brush roller.

It should be appreciated that, by conventional means, (either electrical, mechanical or a combination thereof) a plurality of cleaning devices may be coordinated together for units wherein there are a multiple number of blanket cylinders. It should be similarly appreciated that the amount and frequency and type of solvents that are employed may differ depending upon the type of printing which has been done and the particular sequence of the blanket being cleaned. For example, the initial blanket cylinder in a typical paper printing job may have considerably more clay and anti-offset powder build-up so as to require more water than subsequent blankets. also, the ink build-up on later blankets may be greater than the earlier blankets. With this background in mind, a typical cleaning cycle involves actuation of the pneumatic cylinders 50 to position the brush roller 32 against the blanket surface 22, with the positioning being effected by employing the stops 64'. Typically, the solvent application is initiated so that the bristles will be wet before the blanket cylinder is contacted. Generally, when the blanket cylinder contains gum, clay or other water-soluble imputities, water will be initially applied prior to contact of the brush roller with the surface of the blanket, the exact amount of water employed being dependent upon the extent of the presence of water-soluble impurities.

Following the initial application of water, predetermined amounts of solvent are periodically applied until the blanket is cleaned. The amount of each application or "shot" should, at a minimum, be adequate to cover the normally dull surface of the blanket so as to give the surface a "wet" appearance (i.e. — a shiny appearance) yet not be so excessive as to cause any significant amount to run into the cylinder gap. Subsequent shots should be added at least before any significant amount of drying has occurred on the blanket. This can be visually determined since the shiny appearance begins to fade as drying occurs. To simplify operation, it is preferred to have the amount of solvent in subsequent shots be the same as the original application. However, if desired, the amount of the subsequent shots can be varied so long as significant amounts of solvent are not allowed to run into the gap. Shots are continued until the completion of the cleaning of the surface which can be readily visually determined as by viewing the blanket. For most applications, it has been found to be generally suitable to apply from about 5 to about 9 shots of solvent in amounts ranging from 3 to 5 ounces/shot over a generally suitable to apply from about 5 to about 9 shots of solvent in amounts ranging from 3 to 5 ounces/shot over a period of from about 75 to 105 seconds. The specific amount of solvent applied, the number of applications, the spacing of the applications and the total scrubbing time will depend upon such factors as the size of the press and the type of printing job involved.

The wiper roll is then moved into its operative position by supplying air to the cylinders through lines 52, and the blanket dried. The whole cleaning cycle can be carried out in about 2 to 2½ minutes.

Thus, as has been seen, the present invention provides a means for cleaning surfaces such as the blankets on offset presses in a quick, efficient and reliable manner. Easy accessibility for servicing the unit is also provided, and the unit is essentially self-cleaning through the use of a flicker bar which allows the bristles to flex and be cleaned. The application of the solvent in the manner hereinbefore described, in accordance with the present invention, provides a cleaning action in which the cleaning is maximized with but a minimum of solvent.

I claim as my invention:

1. An apparatus for cleaning a rotating cylindrical surface containing undesired foreign matter thereon comprising, a scrub means including a rotatable brush roller having an axis and substantially radially extending bristles, means for moving the rotatable brush into and out of contact with the surface being cleaned, means for supplying a predetermined amount of solvent for the foreign matter to the bristles of the brush, means including a wiper roller having an absorbent surface for drying the surface which has been scrubbed, means for moving the wiper roller into and out of contact with the scrubbed surface, a flicker bar including a substantially flat inclined surface positioned to contact the bristles at an angle and for a distance sufficient to allow the individual bristles to flex so as to remove the foreign matter therefrom, the flicker bar being positioned with respect to the brush in such a fashion that substantially all of the foreign matter removed from the bristles is not allowed to return to the brush and, a housing having an upper portion for the wiper roller and a lower portion for the brush roller, the upper portion being hingedly connected to the lower portion so that the brush roller may be readily exposed.

2. The apparatus of claim 1 wherein the flicker bar is positioned below the axis of the brush roller and said inclined surface is positioned to initially contact the bristles at an angle from about 45° to about 65° with respect to the radially extended bristles.

3. The apparatus of claim 1 wherein the wiper roller is spring-loaded to bias the roller against the surface being cleaned and is adjustably mounted.

4. The apparatus of claim 1 wherein the means for supplying solvent includes a solvent tube having a series of spaced holes, a plurality of nozzles positioned to receive the solvent discharging from the solvent tube holes and direct the solvent in the form of individual streams away from the brush bristles, and a baffle positioned to intercept the solvent streams and divert the solvent toward the brush to wet the bristles of the brush, the spacing of the holes and the baffle cooperating to provide a substantially continuous stream of solvent for the brush bristles.

5. The apparatus of claim 1 wherein the flicker bar is inclined relative to horizontal at an angle from about 25° to about 45°.

6. The apparatus of claim 1 wherein the flicker bar is inclined relative to horizontal at an angle from about 30° to about 35°.

7. The apparatus of claim 1 which includes stop means for positioning the brush roller and wiper roller in operative contact with the surface being cleaned.

8. The apparatus of claim 1 wherein the brush roller is positioned in an open saddle support.

9. The apparatus of claim 1 wherein the housing includes a drain trough adjacent the brush roller with a downwardly slanting surface from one side of the brush roller to the other, the drain trough being adapted to receive the foreign matter removed from the surface being cleaned and from the bristles of the brush after passing the flicker bar.

10. The apparatus of claim 9 which includes means for passing fluid down the drain trough to prevent build-up of foreign matter.

* * * * *